US006776518B2

(12) United States Patent
Gartland et al.

(10) Patent No.: US 6,776,518 B2
(45) Date of Patent: Aug. 17, 2004

(54) CONTAINER FOR TRANSPORTING AND STORING FIELD CONTROLLABLE FLUID

(75) Inventors: Scott D. Gartland, Holly Springs, NC (US); Donald A. Nixon, Wilson, NC (US); Gary W. Adams, Holly Springs, NC (US); K. Andrew Kintz, Apex, NC (US); Eric T. Byrd, Willow Springs, NC (US)

(73) Assignee: Lord Corporation, Cary, NC (US)

( * ) Notice: Subject to any disclaimer, the term of this patent is extended or adjusted under 35 U.S.C. 154(b) by 106 days.

(21) Appl. No.: 10/074,363

(22) Filed: Feb. 12, 2002

(65) Prior Publication Data

US 2003/0151973 A1 Aug. 14, 2003

(51) Int. Cl.[7] ..... B01F 3/12
(52) U.S. Cl. ..... 366/348; 366/349
(58) Field of Search ..... 366/249, 251, 366/247, 245, 244, 242, 331, 307, 348, 349

(56) References Cited

U.S. PATENT DOCUMENTS

| | | | | | |
|---|---|---|---|---|---|
| 2,008,684 | A | * | 7/1935 | Craddock | 366/249 |
| 2,301,461 | A | * | 11/1942 | Schnetz | 366/251 |
| 2,423,969 | A | | 7/1947 | Foltz | |
| 2,557,622 | A | * | 6/1951 | Trier | 366/249 |
| 2,678,809 | A | | 5/1954 | Seilberger | |
| 3,111,954 | A | * | 11/1963 | Duncan | 366/330.1 |
| 3,132,850 | A | * | 5/1964 | Puchalski | 366/308 |
| 3,539,155 | A | * | 11/1970 | Agranat | 366/251 |
| 3,972,512 | A | | 8/1976 | Grise et al. | |
| 4,032,045 | A | * | 6/1977 | Epple | 366/249 |
| 4,163,616 | A | | 8/1979 | Claunch | |
| 4,422,770 | A | | 12/1983 | Geible | |
| 4,785,963 | A | | 11/1988 | Magley | |
| 4,813,786 | A | * | 3/1989 | LeMaster | 366/331 |
| 4,833,897 | A | * | 5/1989 | Burns | 366/137 |
| 4,884,245 | A | | 11/1989 | McIntosh et al. | |
| 5,102,151 | A | * | 4/1992 | Stolzenfeld | 366/331 |
| 5,199,286 | A | | 4/1993 | Jakubas | |
| 5,203,574 | A | | 4/1993 | Stolzenfeld | |
| 5,251,979 | A | | 10/1993 | Larsen | |
| 5,261,745 | A | | 11/1993 | Watkins | |
| 5,314,310 | A | | 5/1994 | Bachellier | |
| 5,356,214 | A | | 10/1994 | Styles | |
| 5,358,153 | A | | 10/1994 | Caldwell et al. | |
| 5,399,014 | A | * | 3/1995 | Takata et al. | 366/262 |
| 5,417,169 | A | | 5/1995 | Carpenter et al. | |
| 5,489,151 | A | * | 2/1996 | Weber | 366/247 |
| 5,555,796 | A | * | 9/1996 | Kortschot et al. | 366/147 |
| 5,651,613 | A | | 7/1997 | Mays et al. | |
| 5,727,878 | A | | 3/1998 | Sullivan, Jr. | |
| 5,816,136 | A | * | 10/1998 | Stallings | 366/282 |
| 5,816,702 | A | | 10/1998 | Mays et al. | |
| 5,938,332 | A | | 8/1999 | Bachellier | |
| 5,941,636 | A | * | 8/1999 | Lu | 366/249 |
| 5,944,418 | A | * | 8/1999 | Orr et al. | 366/245 |
| 6,203,717 | B1 | | 3/2001 | Munoz et al. | |
| 6,325,532 | B1 | | 12/2001 | King et al. | |
| 6,427,713 | B1 | | 8/2002 | Dempsey et al. | |
| 6,475,404 | B1 | | 11/2002 | Carlson | |
| 6,650,108 | B2 | | 11/2003 | Carlson et al. | |
| 2003/0006395 | A1 | | 1/2003 | Hata et al. | |

FOREIGN PATENT DOCUMENTS

| | | |
|---|---|---|
| WO | WO 02/10281 A1 | 7/2002 |

OTHER PUBLICATIONS

Indco, No. 192 Jul.—Dec. 2000, catalog 60 pp..

* cited by examiner

*Primary Examiner*—Tony G. Soohoo
(74) *Attorney, Agent, or Firm*—Edward F. Murphy, III

(57) ABSTRACT

A container for storing and transporting field controllable fluid is disclosed. The field controllable material may be mixed and remixed in the container and the field controllable material may be flowed into or discharged from the container chamber without opening the container.

33 Claims, 8 Drawing Sheets

CONTAINER FOR TRANSPORTING AND STORING FIELD CONTROLLABLE FLUID

FIELD OF THE INVENTION

The invention relates to a container for transporting and storing a volume of field controllable fluid, and more specifically the invention relates to a field responsive material transport and storage container where the container comprises integral means for mixing and remixing the fluid and such integral mixing means prevents exposing the housed field controllable fluid to airborne contaminants such as dust, dirt, and moisture for example.

BACKGROUND OF THE INVENTION

Field controllable materials such as magnetorheological (MR) and electrorheological (ER) fluids generally are used in linear acting and rotary acting devices, which more specifically comprise dampers or shock absorbers, to control the relative motion between device component parts and thereby produce the damping forces required to control or minimize shock and/or vibration in a damped system. Specific examples of devices that are actuated by a field controllable medium generally include linear dampers, rotary brakes and rotary clutches. The devices include a volume of field controllable (MR) fluid which is further comprised of soft magnetic particles dispersed within a liquid carrier. Typical particles are comprised of a carbonyl iron, and the particles have various shapes and sizes. The most preferred particles are frequently spherical with mean diameters between about 0.1 $\mu$m and about 500 $\mu$m. The particles are suspended in carrier fluids which are comprised of low viscosity hydraulic oils, and the like. In operation, the MR fluids exhibit a thickening behavior (a rheology change) upon being exposed to a magnetic field. The thickening behavior may also be referred to as a change in viscosity. The higher the strength of the field applied across the MR fluid, the greater the viscosity and the higher the motion control force or torque that can be produced by the MR device. The MR fluid is designed to ensure that in combination with the specific device, the requisite motion control forces are produced. The carrier fluid, particle size and particle density are specifically selected based on the application where the MR fluid will be used. It is essential to effective operation of the device that the particle density relative to the carrier fluid be maintained substantially constant and relatively free of contaminants. However, maintaining a field controllable fluid that is of a constant particle density and free from contaminants is difficult using prior art containers.

The field controllable fluid is typically transported in a shipping container to a destination where it is transferred to a device actuated by the controllable fluid. A portion of the total volume of the contained field controllable fluid is transferred to the device(s) and any fluid left in the container after the filling operation has been completed is stored in the container until it is needed to fill one or more additional devices. During shipment and storage in the container the field controllable fluid settles. Over time, which may be a couple of weeks for example, as the fluid settles, the stored field controllable MR fluid eventually arrives at an oil rich volume at the top of the container and higher density, iron rich volume located proximate the bottom of the container. A volume comprising a variable density or density gradient may extend between the oil rich and high density volumes of fluid. The density of the field controllable fluid must be maintained substantially constant in order to ensure that the volume delivered out of the container to an object of interest is comprised of the substantially constant density required to achieve effective operation of the device. The required substantially constant density is obtained by remixing the settled fluid before it is discharged from the container.

The field controllable fluid may be shipped in small volume containers, such as gallon containers, and when the fluid is shipped in such containers the fluid may be remixed by simply shaking the container. The container can be shaken using a well known, conventional paint shaker used to mix paint components or if the container is not too heavy, the small container may be shaken by hand. The relatively small container can be kept closed during storage and mixing and only needs to be opened when it is necessary to acquire a volume of the field responsive fluid. As a result, the level of exposure of the field responsive fluid housed in a small container to airborne contaminants is relatively low.

More frequently the field responsive material is shipped and stored in containers that are large, and such containers may be comprised of fifty-five gallon drums or tote containers with a larger volume that the drums for example. It is more difficult to remix the contents of the large containers than it is to remix the contents of the small containers due to the significant weight of the fluid in the large containers. Additionally, the level of exposure of the field responsive fluid housed in a large container to airborne contaminants is high. Commercially available large shipping containers for such fluid must be opened each time it is necessary to remix the field controllable fluid. A discrete mixing element is placed in the container and immersed in the fluid and then the motor for driving the member is connected to the mixing element and the motor is then actuated. During the period when the container is opened, airborne contaminants and other matter are entrained into the container chamber where they become commingled with the field controllable fluid. The commingled contaminants can negatively affect the density and functionality of the field controllable material. Additionally, not only does opening the container offer the opportunity for contaminants to enter the container, but it also offers the material in the container the opportunity to splash or spill out of the container. Loss of a significant volume of material can permanently, negatively affect the density of the material.

The foregoing illustrates limitations known to exist in present containers for transporting and storing field responsive material. Thus, it is apparent that it would be advantageous to provide an alternative directed to overcoming the limitations set forth above. Accordingly, a suitable alternative container is provided including features more fully disclosed hereinafter.

SUMMARY OF THE INVENTION

In one aspect of the present invention this is accomplished by providing a combination that comprises a container having a first container end, a second container end and a wall extending between the first and second container ends. The container defining a chamber and the first and second container ends are closed. The container further comprises an inlet port and a discharge port; a mixing element located in the chamber; a driven member comprising a first member end made integral with the mixing element and a second member end located outside of the chamber, the second member end including a first coupling means. A motive force supplying means is adapted to be removably located at one container end, and the motive force supplying means comprises second coupling means adapted to be coupled with the first coupling means to drive the driven member and integral mixing element. A volume of a field responsive material is housed in the chamber. The driven member and mixing element remain within the chamber during filling, mixing and remixing and discharging the chamber contents. The chamber is never opened thereby preventing contaminants from relocating into the chamber.

The field responsive material may be comprised of a magnetorheological or electrorheological fluid. Most preferably the mixing element is comprised of a cylindrical squirrel cage. The discharge port may be located along the sidewall, along the second container end or along the lid member that closes the first container end. The lid is maintained at the first container end by a coupling member and removal of the coupling member is prevented by a tamper evidence member.

The foregoing and other aspects will become apparent from the following detailed description of the invention when considered in conjunction with the accompanying drawing figures.

DETAILED DESCRIPTION OF THE PREFERRED EMBODIMENTS

Figure 1:
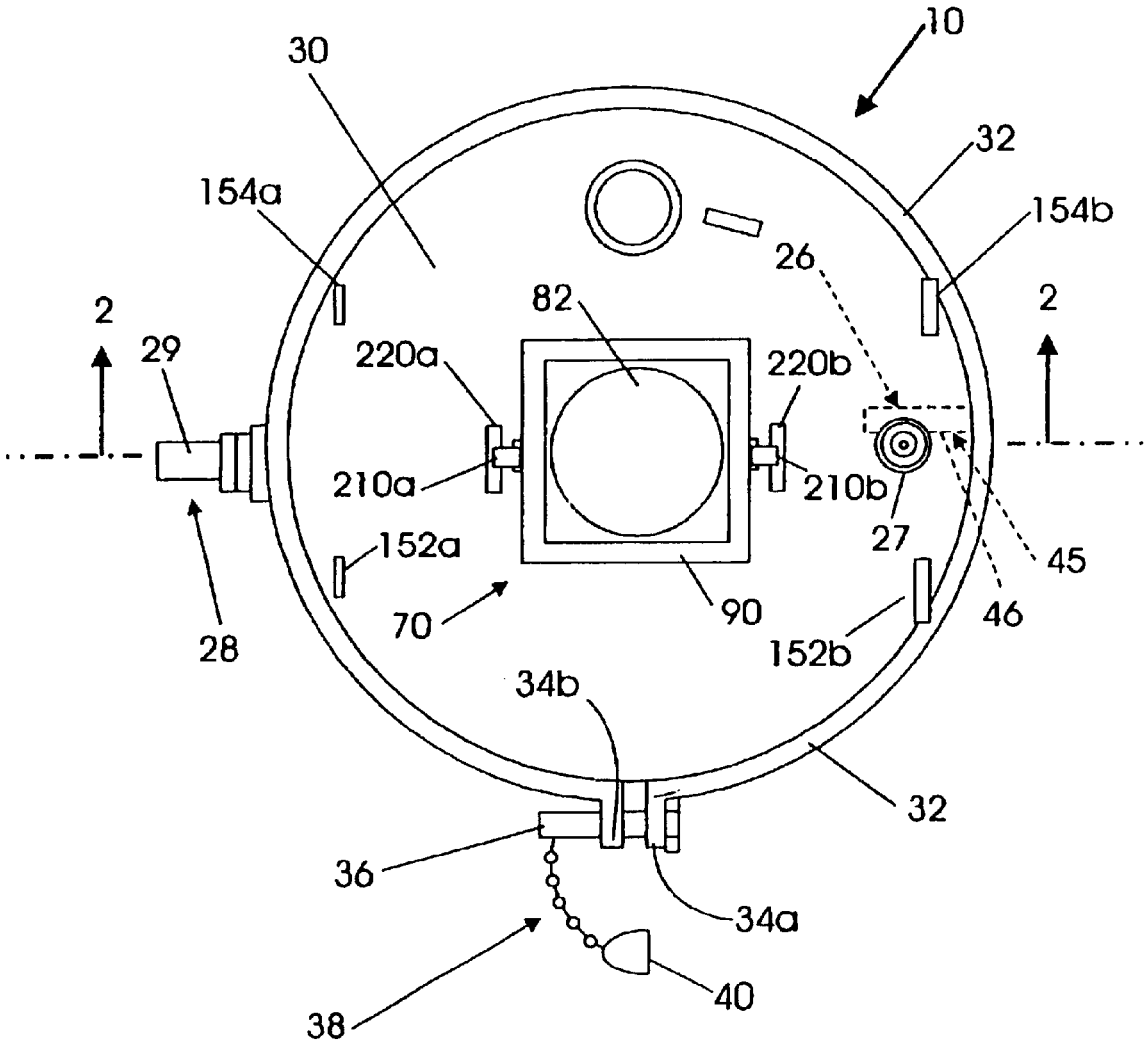
FIG. 1 is a top plan view of the container first end with the prime mover coupled to the container.
Figure 2:
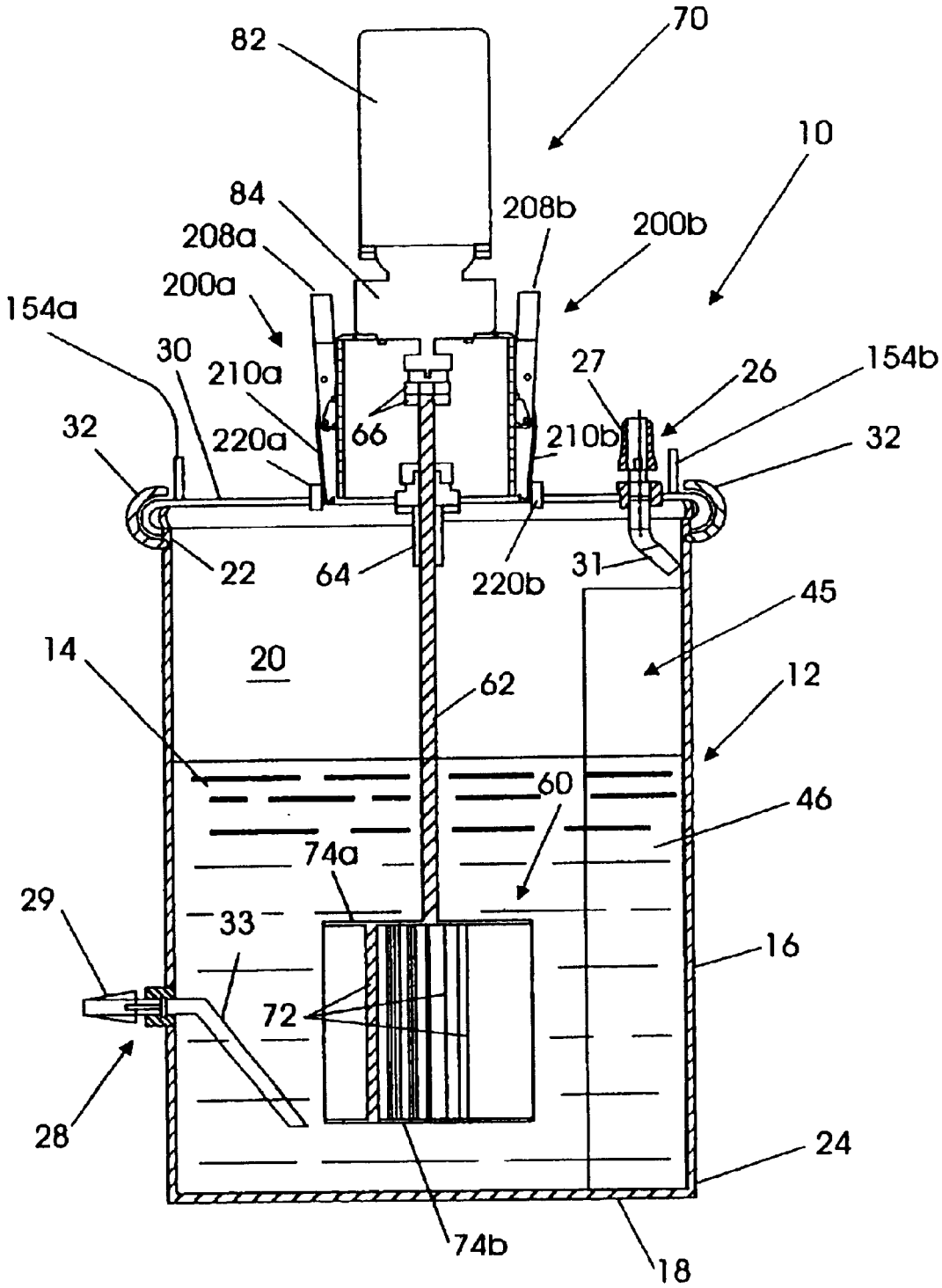
FIG. 2 is a generally longitudinal sectional view taken along line 2—2 of FIG. 1.

Now turning to the drawing figures wherein like parts are referred to by the same numbers in the several views, FIGS. 1 and 2 illustrate a first embodiment invention 10 for storing and transporting field controllable material such as magnetorheological fluid for example. For purposes of clarity, as the description proceeds the terms "field controllable material" or "field controllable fluid" or "MR fluid" shall generally all mean any material with a viscosity that is varied based on the application of a field across the material. It should be understood that field controllable material may also comprise electrorheological (ER) material, but for purposes of describing the preferred embodiments of the invention the field responsive material will be comprised of an MR fluid. However all of the benefits associated with transporting and storing MR fluid in the container of the present invention are realized when ER fluid is transported and stored in the present invention container.

The invention 10 generally comprises container 12 which more specifically might comprise a hollow fifty-five (55) US gallon drum or barrel for example. By way of another specific example, the container may also comprise a square container referred to as a tote by those skilled in the art, and such tote containers may have volumetric capacities between 250 and 600 US gallons. The container 12 is most generally any vessel that is suitable for holding a volume of field responsive material 14, such as a magnetorheological fluid. For purposes of describing the preferred embodiments of the invention, the container 12 is substantially cylindrical and includes sidewall 16, open first container end 22, closed second container end 24 and bottom wall 18 that serves to close the second container end. The sidewall 16 and bottom 18 in combination define container chamber 20. Although the container 12 is disclosed as a unitary vessel having sidewall 16 and bottom 18, it should be understood that the bottom may be comprised of a discrete member that is made integral with the container at the second end 24.

The container 12 may include at least one stationary baffle member 45. The container of the present invention as illustrated in FIGS. 1 and 2 includes a single rigid baffle member however, it should be understood that any number of baffles may be located in chamber 20 to ensure that the required mixing of material 14 is achieved. The larger the volume of field controllable fluid stored in the container, the more desirable it is to provide the supplemental mixing that the at least one baffle provides. As shown in FIG. 2, the baffle member 45 is made integral with the inner portion of sidewall 16 and the baffle extends axially through the chamber between the container ends and also extends radially between the outer periphery of mixing element 60 and the sidewall 16. The baffle is made integral with sidewall 16 using a conventional weld or other suitable process for example. The baffle may have any suitable shape and may be oriented at any angle relative to the sidewall 16. For purposes of describing the preferred embodiments of the invention, the baffle extends radially outwardly substantially perpendicular to the sidewall and has rectangular contact faces 46. It should be understood that the at least one baffle could be made integral with the underside of the lid 30. Such an alternate embodiment baffle would extend axially between the container ends and be located radially between the outer periphery of the mixing element and sidewall.

The first container end 22 is closed by lid 30. The lid is secured to the container 12 at the first container end 22 by a relatively rigid c-shaped clamp 32. See FIG. 1. The clamp 32 has a pair of ends and at each clamp end is an outwardly extending flange 34*a* and 34*b* which, as shown in FIG. 1, are closely parallel. A rigid coupling member 36 such as a bolt or other rigid, elongate member is inserted through both flanges and is maintained therethrough by tamper indicator means 38. The member 36 is inserted through the flanges after the clamp is located around the lid and container first end 22. As shown in FIG. 1 means 38 is comprised of a tamper evidence tag, a portion of which is passed through the body of coupling member 36 to prevent removal of the coupling member from the flanges 34*a* and 34*b*. In this way, inadvertent removal of the lid is prevented. If the lid is removed, the exposed fluid may be identified by the broken tag 38.

Tamper indicator means 38 is comprised of any suitable tamper indicator but most preferably means 38 is comprised of the type of well known tamper indicator device that is attached to a member to prevent a certain type of activity and once the tamper indicator device is removed the same tamper indicator device cannot be reattached to the member. In such tamper indicators, the integrity of the indicator means is destroyed when the activity it seeks to prevent occurs thereby rendering it unsuitable for reuse. In the present invention, indicator 38 is rendered unusable when the coupling member 36 is removed from the flanges 34*a* and 34*b*. Additionally, the indicator means 38 may include a unique indicia on tag 40 such as a serial number for example. The indicia would be unique for a specific container. The serial number or other indicia may be used as further evidence of tampering with the container contents and may also be used as a means for tracking the source, shipping history and age of the container and its contents for example.

As shown in FIG. 2, inlet 26 for filling and refilling the chamber with fluid 14 is provided in lid 30 and discharge port 28 for flowing the fluid from the chamber 20 to an object of interest such as a damper, for example is provided in sidewall 16. Conventional quick disconnect type couplings 27 and 29 are respectively attached to the inlet and discharge ports along the exterior of the container and provide a quick and efficient means for flow connecting and disconnecting a flow conduit such as a discrete hose for example to the inlet and discharge ports. Flow connected to the couplings 27 and 29 are respective flow conduits 31 and 33 through which the material is respectively flowed into and out of the chamber 20. As shown in FIG. 2, the inlet conduit 31 is directed toward the interior of the sidewall 16 to cause the fluid to flow against and down the wall 16. In this way, the fluid is mixed as it is supplied to the chamber and as a result, as filled, the fluid 14 has a substantially consistent density. Discharge conduit 33 is directed inwardly toward the center of the chamber proximate the bottom 18. The conduit 33 may be located closer to the bottom 18 if desired.

Figure 3:
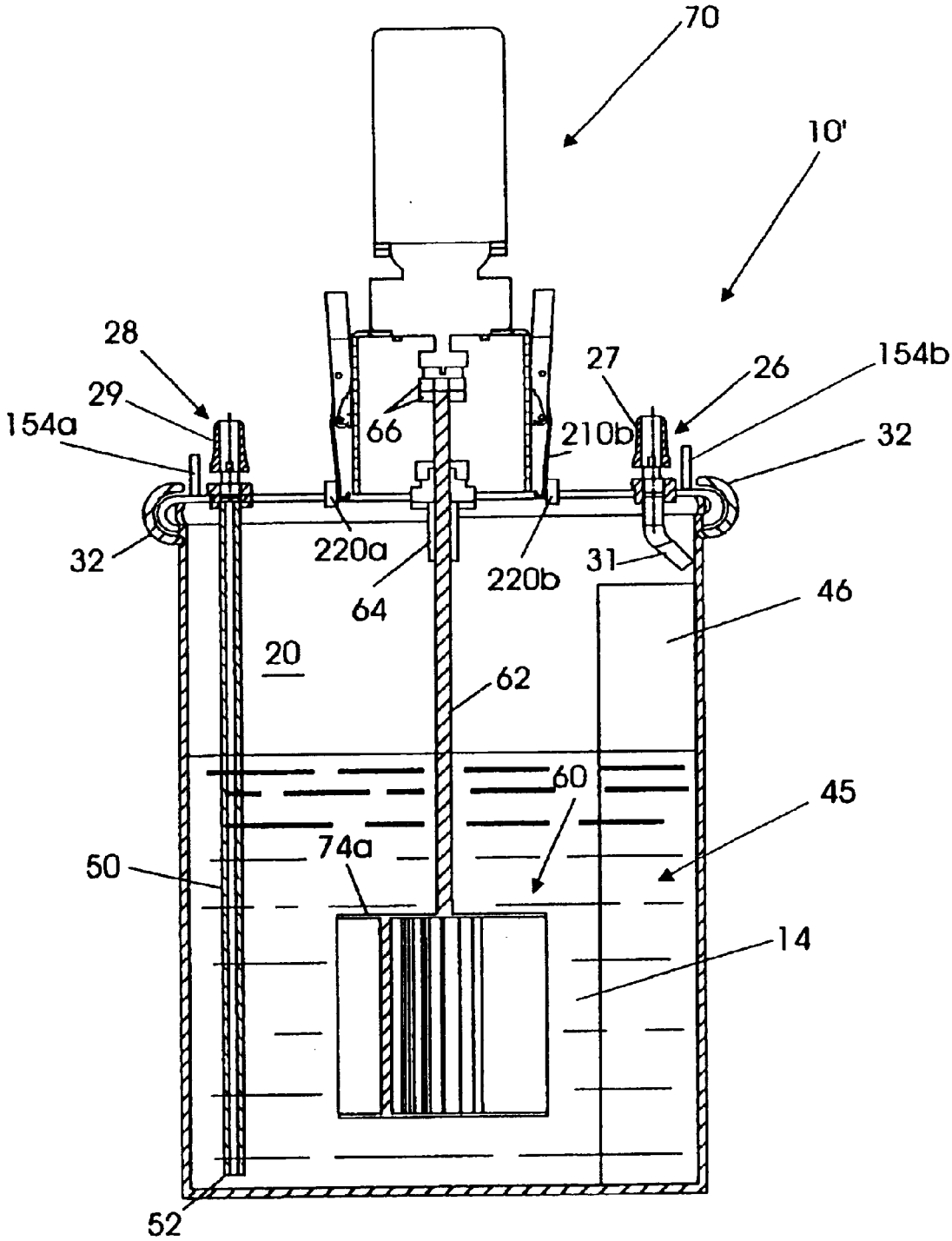
FIG. 3 is a generally longitudinal sectional view like the sectional view of FIG. 2 illustrating an alternate embodiment container of the present invention.

An alternate embodiment of the present invention is identified at 10' in FIG. 3. In the alternate embodiment the discharge port 28 is provided in the lid 30 along with inlet 26 previously described. The discharge port is the same as previously described hereinabove in connection with invention 10. The alternate embodiment invention 10' comprises an elongate discharge conduit 50 that extends axially parallel to the central longitudinal axis with an inlet end 52 located proximate bottom 18. With the exception of the location of the discharge port and conduit 50, the alternate embodiment container 10' is the same as container 10 as previously described and as will be described hereinbelow.

Mixing element 60 is located in the chamber 20 and is made integral with a driven member 62 which may be an elongate, rigid shaft. The mixing element is made integral with the driven member at one end of the driven member by any suitable and conventional means well known to one skilled in the art such as by fasteners, or a weld connection for example. The driven member 62 is supported as it passes through lid 30 by a conventional bearing/seal arrangement 64 and such bearing/seal arrangement may be comprised of a flange bearing for example. The driven member and mixing element remain in their fixed position extending through the lid and into the chamber during filling, transportation, discharge and storage of the container. In this way the lid never needs to be removed and contaminants are not entrained in the chamber 20.

Figure 4:
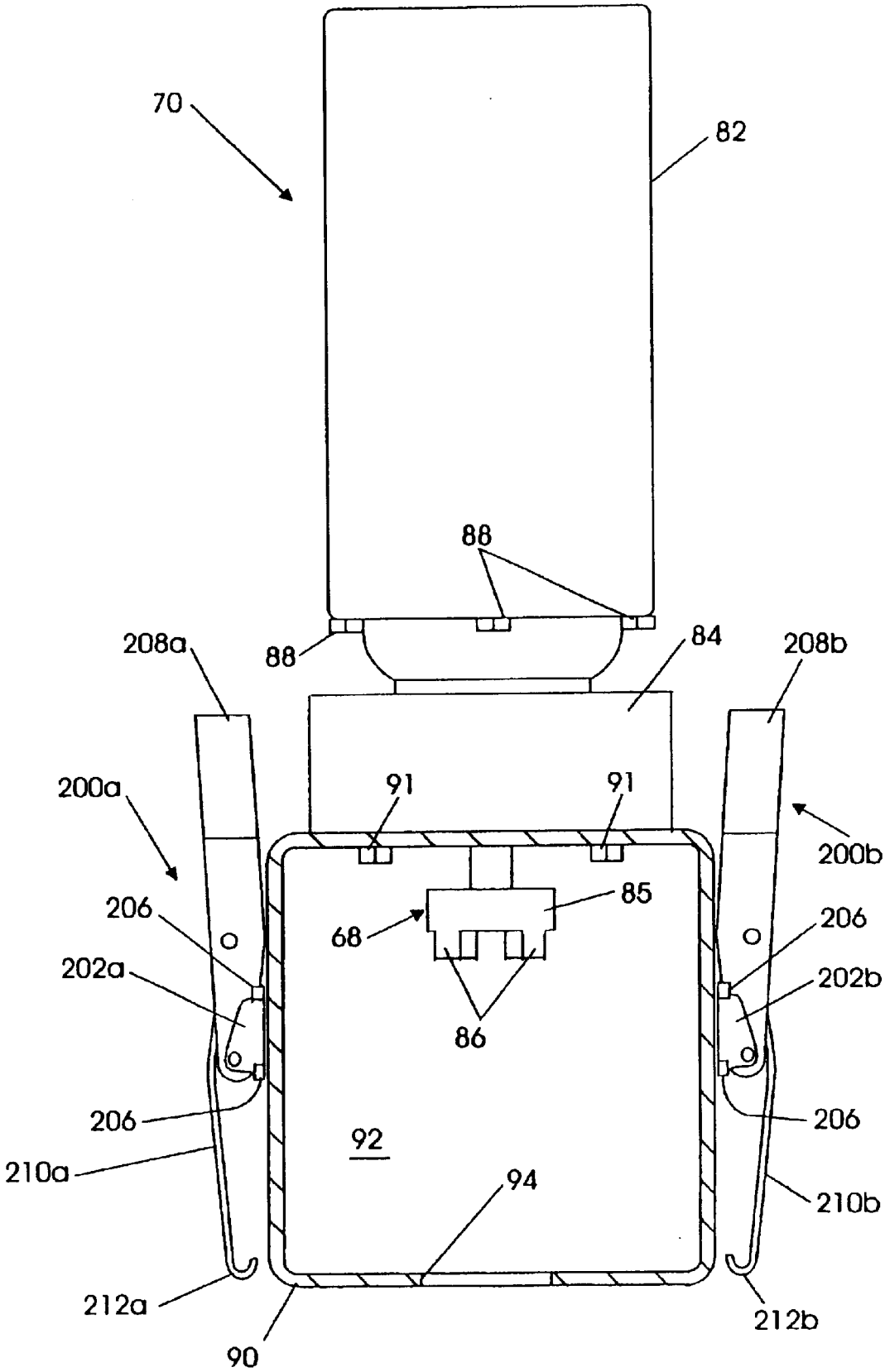
FIG. 4 is an enlarged view of the removable prime mover assembly.

A first coupling member 66 of a conventional torque coupling is made integral with the end of drive member 62 located outside of the chamber adjacent lid 30. The member is comprised of a base with a number of equally spaced teeth spaced around the base. Second coupling member 68 adapted to be mated with member 66 is connected to the removable prime mover 70 shown in FIG. 4. The second coupling member and prime mover will be discussed in greater detail hereinbelow.

Figure 5A:
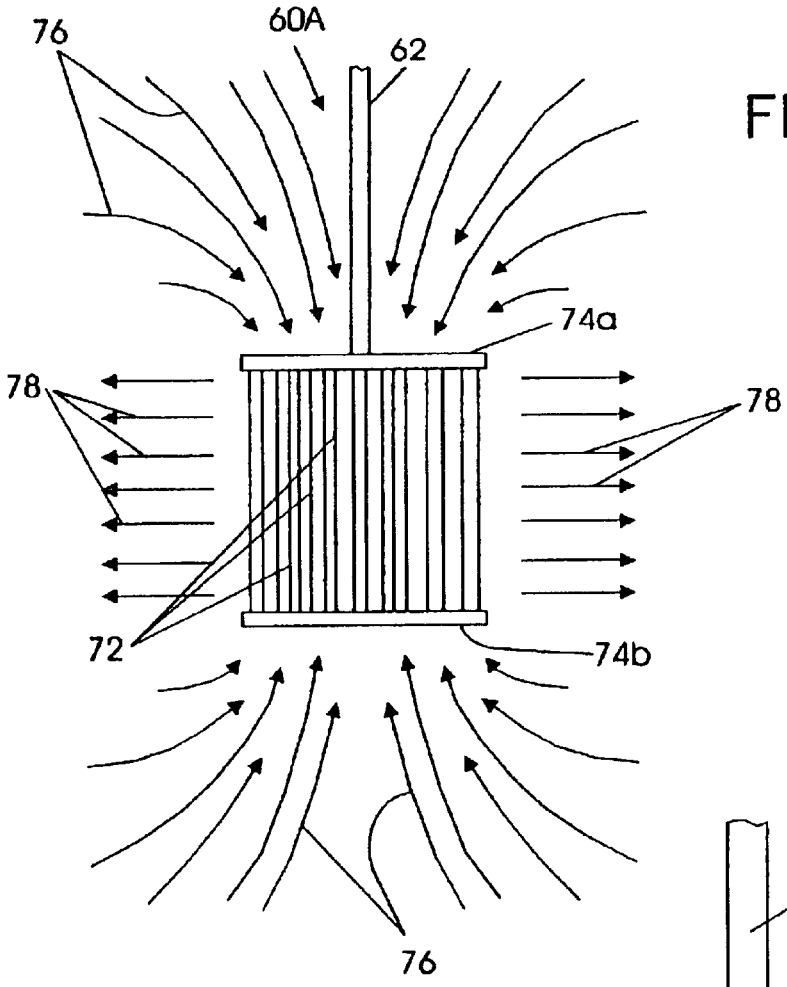
FIGS. 5A, 5B, 5C, 5D and 5E illustrate alternate embodiment mixing elements for mixing the field controllable material housed in the container of the present invention.

Now returning to mixing element 60, for purposes of describing the preferred embodiments of the invention, the mixing element 60 is comprised of a device referred to by those skilled in the art as a squirrel cage. As shown in FIGS. 2 and 5A, the unitary squirrel cage comprises a substantially cylindrical configuration that includes of a plurality of blades 72 that are spaced radially from and substantially parallel to a central axis of rotation of the cage. The ends of the blades are made integral with inlet rings 74*a* and 74*b* that are spaced axially from each other. As shown in FIG. 5A, during rotation of the mixing element, the material in the chamber 20 is drawn into the mixing element through the inlet rings in the direction identified by arrows 76 and then is discharged outwardly through the spaces separating the blades in the radial direction general identified by arrows 78. The combination of the inlet rings and blades provides the cylindrical configuration of cage 60. The squirrel cage represents the most preferred embodiment mixing element 60.

Figure 5B:
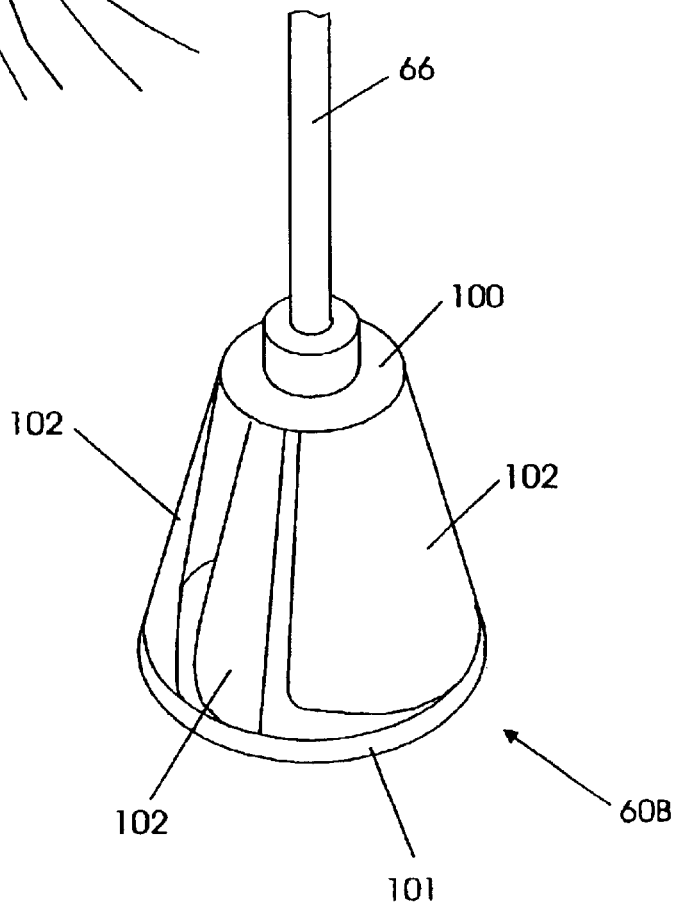
Figure 5E:
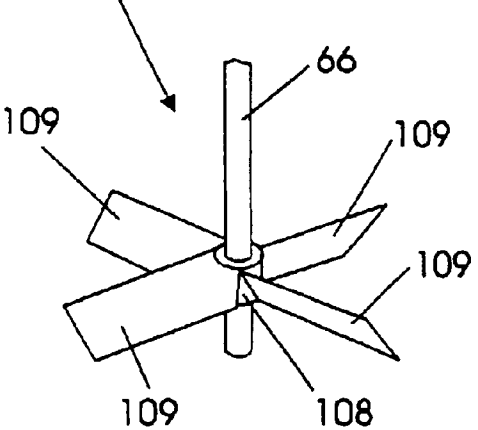
Figure 5D:
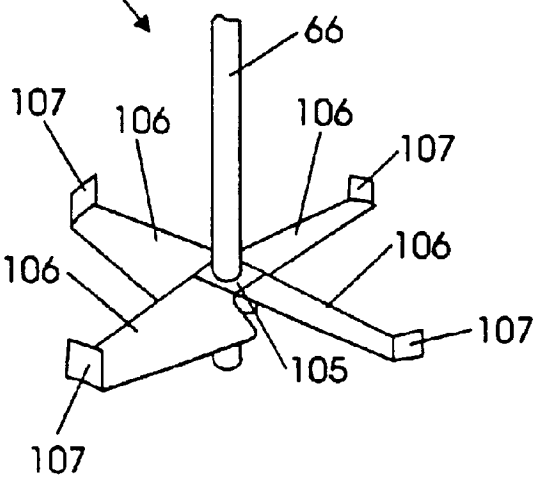
Figure 5C:
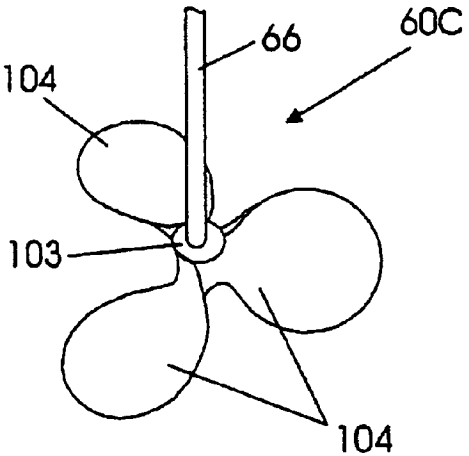

FIGS. 5B, 5C, 5D and 5E illustrate alternate embodiment mixing elements. The mixing element 60B illustrated in FIG. 5B is a conventional vortex mixer. The vortex mixer comprises an upper hub 100 connected to shaft 66, a lower ring 101 and a plurality of inwardly curved blades 102 extending axially between the hub and ring and spaced around the center of the mixer element 60B at a radial distance. The mixing element 60C illustrated in FIG. 5C is a conventional propeller type mixing element comprising a central hub 103 connected to shaft 66 and a plurality of propeller blades 104 spaced around the hub. The mixing element 60D illustrated in FIG. 5D is a conventional hydrofoil mixer. The hydrofoil mixer is comprised a hub 105 connected to shaft 66 and a plurality of elongate blades 106 spaced around the hub. Each blade includes an upwardly extending mixing fin 107 at the tip of the blade. The mixing element 60E illustrated in FIG. 5E is a conventional 45° axial weld mixer comprised of a hub 108 connected to shaft 66 and a plurality of blades 109 oriented at an angle of 45° relative to the direction of rotation of the mixing element.

Prime mover 70 is removable mounted on the lid 30 of the combination of present invention 10. Prime mover may be any suitable device that can rotate the drive member 62 and mixing element 60 at the speeds required to effectively mix fluid 14. For purposes of describing the preferred embodiment of the invention the prime mover is an electric motor 82. The speed of the motor may be precisely controlled so that the contents of the chamber are mixed by element 60 at the most desirable rate. The motor is gear reduced by conventional gearing 84 shown schematically in FIGS. 2 and 4. Coupling member 68 is connected to the gearing and is driven by the motor 82. The second coupling member 68 includes teeth 86 adapted to mesh with the similar teeth of the first coupling member 66. The teeth 86 are spaced equidistantly around the base 85 of the coupling member 68.

The motor unit 82 is conventionally connected to the gear housing 84 by fasteners 88 and the housing is in turn fastened to housing 90 by fasteners 91. The housing encloses coupling member 68 in housing chamber 92 and is seated on lid 30 when the prime mover is coupled to the driven member coupling 66. The coupling member 66 is inserted into the chamber 92 and in mating engagement with coupling 68 through opening 94 provided in the housing.

Toggle clamps 200*a* and 202*b* which in turn are made integral with the housing 90 by screws or other fasteners 206. The toggle clamps are substantially the same and each is comprised of a handle 208*a*, 208*b* pivotally supported by a respective flange 202*a* and 202*b* and a downwardly extending retention member 210*a*, 210*b* fixed to the repective handle with each retention member terminating in a hook shaped end 212*a*, 212*b*. The retention members are biased outwardly away from housing 90 by biasing means (not shown) such as a coil spring for example. When it is necessary to locate the prime mover on the container lid 30, the handles are rotated away from the housing to overcome the outward bias and thereby move the retenttion member ends toward the housing 90. Once the prime mover 70 is located on the lid and the coupling members 66 and 68 are fully engaged as shown in FIG. 2, the ends 212*a*, 212*b* of the retention members are located between the stop members 220*a*, 220*b* and the housing. The handles are released and the members 210*a* and 210*b* are biased outwardly from the housing, until the ends 212*a*, 212*b* contact respective stops 220*a*, 220*b*. See FIG. 1.

The prime mover 70 may be easily and quickly connected and disconnected form the driven member. When filling the container is required, a hose or other discrete flow member is flow connected to inlet port 26 and the fluid is flowed into chamber 20 until the chamber contains the required volume of material. The supply conduit is then quickly disconnected from the coupling 27. When it is necessary to mix the fluid, the prime mover 70 is connected to the driven member and is turned on for the required period of time and speed. Once the mixing operation is completed the prime mover is uncoupled and taken off of the lid 30. When it is necessary to dispense a volume of material from the chamber, a conduit is flow connected to the discharge coupling 29 and the material 14 is flowed from the chamber 20 to an object of interest such as a damper for example. Once the dispensing operation is completed the discharge conduit is disconnected from the coupling 29. In this way remixing material 14 and dispensing and refilling the contents of chamber 20 may be accomplished quickly, efficiently and without exposing the chamber to contaminants. The lid 30 is never removed from the container 12 during any of the filling, dispensing or remixing operations.

The container of the present invention represents an improvement over other means for storing and transporting field controllable fluid for at least the following reasons: 1) the container of the present invention is essentially sealed from incidental contact or contamination for example from airborne dirt, dust and moisture; 2) the fluid stored in the container chamber is capable of remixing without opening the container; 3) the container is capable of repeated shipping cycles when empty or full thereby minimizing shipping costs; 4) the prime mover means provides for speed control of the mixing operation; and 5) the container is relatively easy to connect and disconnect from flow conduits.

Figure 6:
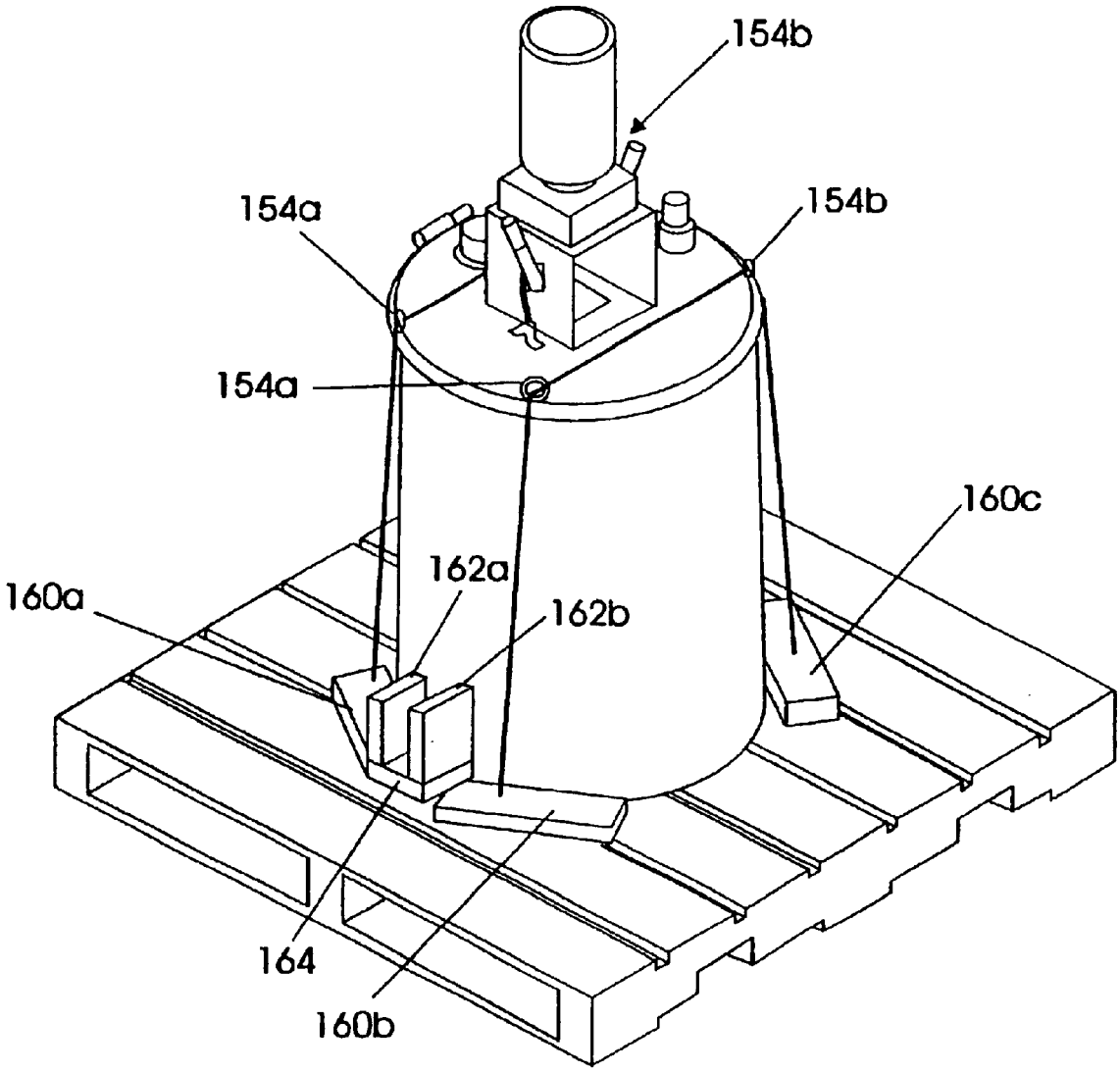
FIG. 6 is a perspective view of the container of the present invention fixed to a suitable shipping base.
Figure 7:
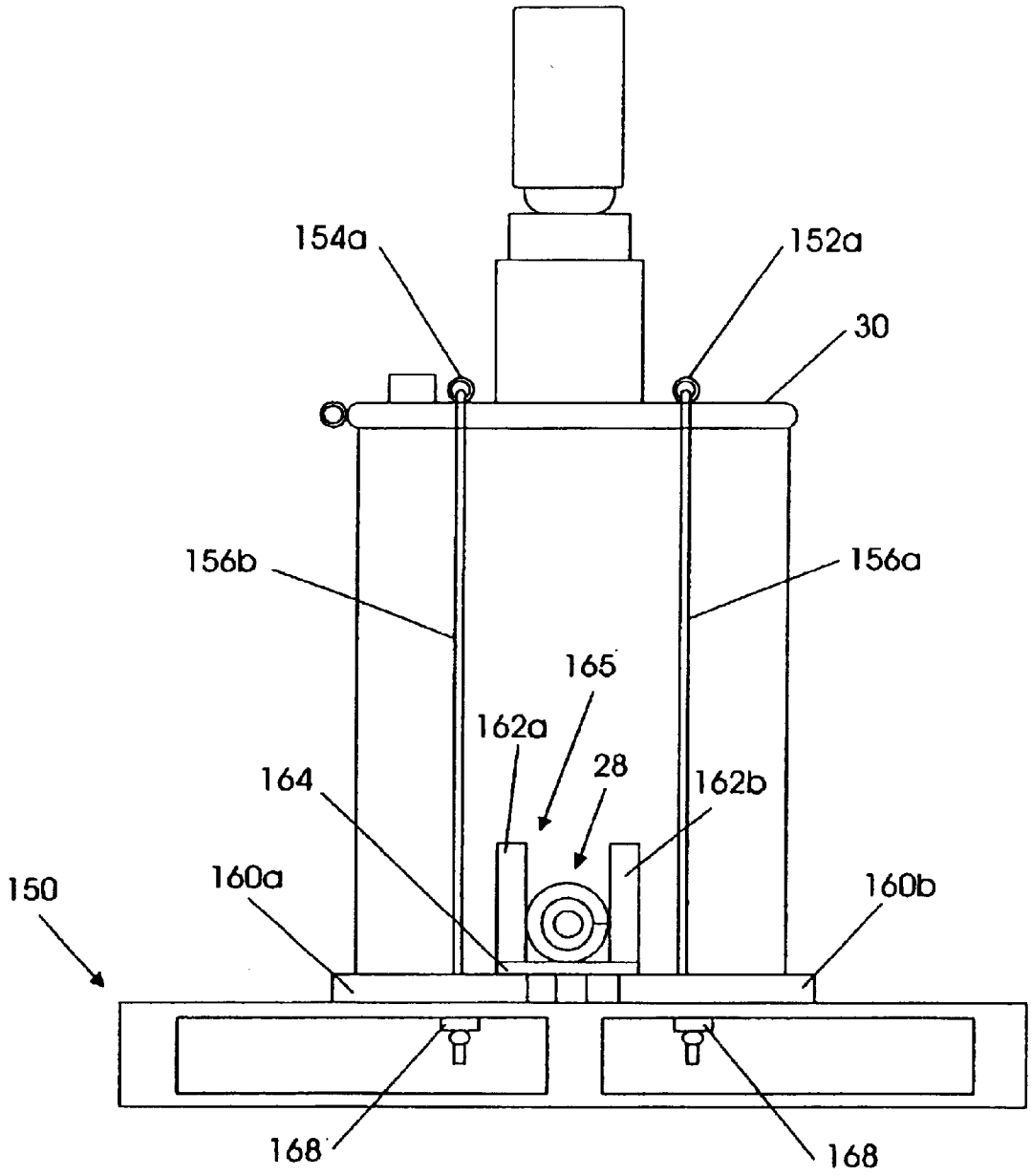
FIG. 7 is a front plan view of the container of FIG. 6.

The container 10 is shipped to its required destination removably fixed to a base such as a pallet or other suitable support platform. In FIGS. 6 and 7 the container 10 of the present invention is shown supported on a suitable base 150. The most suitable base must be specially suited to support the considerable load of the container filled with field controllable fluid. A suitable pallet may be made from an oak wood for example. As shown in FIG. 6, four feet 160*a*, 160*b*, 160*c* and 160*d* (not illustrated) are made integral with base 150 by conventional fastener means such as screws for example and each foot includes a hole extending therethrough. The feet are located on the base 150 in a spaced relationship so that the movement of the second end of the container along the top of the base is constrained by the feet butted against the second container end. Retention rings 152 are made integral with the exterior face of lid 30 along the outer periphery of the lid. As shown in FIG. 6, pairs of rings 152*a*, 152*b* are aligned laterally as are rings 154*a*, 154*b*. Ring 154*b* is not visible in FIG. 6 or 7 and is illustrated most clearly in FIG. 1. Flexible strap members 156*a*, 156*b* are passed through the respective pairs of rings 152*a,b* and 154*a,b* and the ends of the straps extend through the openings in the respective foot. As shown in FIG. 7, each strap end is located beneath the top of the pallet where it is prevented from displacement outwardly by a knot or other anchor means such as a plate washer 168.

A shroud 165 is made integral with feet 160*a* and 160*b*. The shroud includes upwardly extending sides 162*a*, 162*b* that are made integral with base 164. The base is in turn made integral with feet 160*a*, 160*b* by a suitable conventional means. The discharge port 28 is located within the shroud when the container is seated on the pallet and between the feet. See FIG. 7. In this way, the discharge port is accessible but is also protected by the shroud to thereby prevent damaging the discharge port during shipment or when the pallet is located for use in a location of interest.

While we have illustrated and described a preferred embodiment of our invention, it is understood that this is capable of modification and therefore we do not wish to be limited to the precise details set forth, but desire to avail ourselves of such changes and alterations as fall within the purview of the following claims.

What is claimed is:

1. A method of making a magnetorheological device, said method comprising, providing a container at a magnetorheological fluid manufacturing location, the container comprised of a first container end, a second container end and a wall extending between the first and second container ends, the container defining a chamber, the first and second container ends being closed, the container further comprising an inlet port and a discharge port;

a mixing element located in the chamber;

a driven member comprising a first member end made integral with the mixing element and a second member end located outside of the chamber, the second member end including a first coupling means;

dispersing a plurality of soft magnetic particles in a liquid carrier to provide a magnetorheological fluid, said magnetorheological fluid having a selected soft magnetic particle density, filling said container via said inlet port at said magnetorheological fluid manufacturing location with said magnetorheological fluid having said selected soft magnetic particle density, transporting said magnetorheological fluid in said container to a destination location, coupling a motive force to the first coupling means to drive said driven member and integral mixing element at said destination location inorder to provide said selected soft magnetic particle density, transferring a portion of said magnetorheological fluid with said selected soft magnetic particle density through said discharge port to a magnetorheological device at said destination location to provide a magnetorheological device containing said magnetorheological fluid at said destination location, said magnetorheological device containing said magnetorheological fluid with said selected soft magnetic particle density, returning said container to a magnetorheological fluid manufacturing location and refilling said container with a magnetorheological fluid comprised of a plurality of soft magnetic particles in a liquid carrier.

2. The method as claimed in claim 1 wherein dispersing a plurality of soft magnetic particles in a liquid carrier to provide a magnetorheological fluid comprises dispersing a plurality of iron particles in an oil.

3. The method as claimed in claim 1 wherein the container is a drum having a volumetric capacity equal to fifty-five gallons.

4. The method as claimed in claim 1 wherein the container is comprised of a drum having a volumetric capacity of about fifty-five gallons.

5. The method as claimed in claim 1 wherein the discharge port is located between the first and second container ends.

6. The method as claimed in claim 5 wherein the discharge port is located in the container wall.

7. The method as claimed in claim 6 wherein the inlet is located at the first end.

8. The method as claimed in claim 5 wherein the inlet is located at the first container end.

9. The method as claimed in claim 1 wherein the discharge port is located at the first end.

10. The method as claimed in claim 1 wherein the mixing element is comprised of a squirrel cage.

11. The method as claimed in claim 1 wherein the mixing element is comprised of a propeller mixer.

12. The method as claimed in claim 1 wherein the mixing element is further comprised of an axial weld mixer.

13. The method as claimed in claim 1 wherein the mixing element is further comprised of a hydrofoil mixer.

14. The method as claimed in claim 1 wherein the mixing element is further comprised of a vortex mixer.

15. The method as claimed in claim 1 wherein the first end is closed by a lid, the lid being secured to the first container end by attachment means.

16. The method as claimed in claim 15 wherein the attachment means comprises means for indicating if the lid is removed.

17. The method as claimed in claim 1 wherein the motive force is comprised of an electric motor.

18. The method as claimed in claim 1 wherein the first coupling means is comprised of a torque coupling.

19. The method as claimed in claim 17 wherein the electric motor is removably coupled to the container by at least two toggle clamps that engage flange means on the container.

20. The method as claimed in claim 1 wherein the container further comprises a flow conduit flow connected to the inlet port, the flow conduit extending into the chamber, the flow conduit having a conduit discharge end located proximate the container wall.

21. The method as claimed in claim 1 wherein dispersing a plurality of soft magnetic particles in a liquid carrier to provide a magnetorheological fluid comprises dispersing a plurality of carbonyl iron particles with a mean diameter between 0.1 $\mu$m and about 500 $\mu$m.

22. The method as claimed in claim 1 wherein the discharge port is located at the second end.

23. The method as claimed in claim 1 wherein at least one baffle is located in the chamber.

24. The method as claimed in claim 23 wherein the at least one baffle is made integral with the container wall.

25. The method as claimed in claim 23 wherein the at least one baffle is substantially perpendicular to the wall.

26. The method as claimed in claim 23 wherein the at least one baffle has a rectangular shape.

27. The method as claimed in claim 23 wherein the at least one baffle extends axially between the container ends.

28. The method as claimed in claim 1 wherein the container is comprised of a drum having a volumetric capacity between about two hundred fifty and about six hundred gallons.

29. A method for providing a magnetorheological fluid with a selected soft magnetic particle density, said method comprising: providing a container, said container having a first container end, a second container end and a wall extending between the first and second container ends, the container defining a chamber, a mixing element fixedly located in the chamber; a driven member comprising a first member end made integral with the mixing element and a second member end located outside of the chamber, the second member end including a first coupling means;

providing a magnetorheological fluid having a selected soft magnetic particle density, storing said magnetorheological fluid in said container chamber, coupling a motive force to said first coupling means and driving said driven member and said integral mixing element inorder to remix said stored magnetorheological fluid in said container chamber to provide said selected soft magnetic particle density, dispensing said remixed stored magnetorheological fluid from said container.

30. The method as claimed in claim 29 wherein providing a magnetorheological fluid having a selected soft magnetic particle density comprises dispersing a plurality of iron particles in an oil.

31. The method as claimed in claim 29 wherein the container is made integral with a base.

32. The method as claimed in claim 29 wherein providing a magnetorheological fluid having a selected soft magnetic particle density comprises dispersing a plurality of carbonyl iron particles with a mean diameter between 0.1 $\mu$m and about 500 $\mu$m in a liquid oil.

33. The method as claimed in claim 29 wherein said container includes a discharge port located on the wall near the second end, the discharge port being substantially enclosed by a shroud.

* * * * *